United States Patent [19]

Stern et al.

[11] Patent Number: 4,845,449

[45] Date of Patent: Jul. 4, 1989

[54] MILLIMETER WAVE MICROSTRIP MODULATOR/SWITCH

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 266,953

[22] Filed: Nov. 3, 1988

[51] Int. Cl.[4] ..... H01P 1/11

[52] U.S. Cl. ..... 333/258; 333/102; 333/24.3; 333/262

[58] Field of Search ..... 333/1.1, 102, 24.1, 333/24.2, 158, 258, 262, 24.3

[56] References Cited

U.S. PATENT DOCUMENTS

| | | | |
|---|---|---|---|
| 2,719,274 | 9/1955 | Luhrs . | |
| 3,018,454 | 1/1962 | Sferrazza . | |
| 3,064,214 | 11/1962 | Miller . | |
| 4,458,218 | 7/1984 | Babbitt et al. | 333/158 |
| 4,490,700 | 12/1984 | Stern et al. | 333/258 |
| 4,806,886 | 2/1989 | Stern et al. | 333/24.2 |
| 4,816,787 | 3/1989 | Stern et al. | 333/158 |

*Primary Examiner*—Paul Gensler

*Attorney, Agent, or Firm*—Michael J. Zelenka; Robert A. Maikis

[57] ABSTRACT

A microstrip switch is provided comprising a rectangular ferrite rod having a pair of ramp-shaped dielectric waveguide members at the ends thereof. The ramp members are made of dielectric waveguide material having a dielectric constant which is substantially the same as the dielectric constant of the ferrite. The rod and ramp members are mounted on one surface of a microstrip dielectric substrate having a dielectric constant substantially less than the dielectric constant of the ramp members and a ground plane on the other surface thereof. Input and output sections of microstrip conductor are mounted on the surface of the substrate and the sloping surfaces of the ramp members in axial alignment with the rod and ramp members. A helical coil surrounding the rod and passing through the substrate and ground plane is selectively energized to produce a unidirectional magnetic field along the longitudinal axis of the rod which causes Faraday rotation of RF wave energy passing through the rod from the input microstrip section and subsequent misalignment of the RF wave energy exiting from the rod to the output microstrip conductor section.

5 Claims, 1 Drawing Sheet

MILLIMETER WAVE MICROSTRIP MODULATOR/SWITCH

STATEMENT OF GOVERNMENT RIGHTS

The invention described herein may be manufactured, used and licensed by or for the Government for governmental purposes without the payment to us of any royalties thereon.

BACKGROUND OF THE INVENTION

1. Field of the Invention

This invention relates to microstrip transmission lines and microstrip transmission line components operating in the millimeter wave region of the frequency spectrum and more particularly to a microstrip modulator/-switch for use with such microstrip transmission lines and microstrip components.

2. Description of the Prior Art

Modulator/switch devices suitable for use with microstrip transmission lines and microstrip components operating in the millimeter wave region of the frequency spectrum have not heretofore been developed. Since much equipment has been developed today for use in the millimeter wave region of the frequency spectrum and since such equipment is often designed with planar circuitry utilizing microstrip transmission lines and microstrip components because of the substantial savings in size and weight achieved thereby, a need has arisen for a microstrip modulator/switch which is capable of operating in this region of the frequency spectrum. For example, such microstrip modulator/switch devices could be used to modulate millimeter wave energy for various systems applications or could be used as a protective type switch in radar systems and the like to protect sensitive millimeter wave receivers during the time that the millimeter wave transmitter is transmitting.

Essentially, a nodulator/switch device suitable for use in the millimeter wave frequency region must provide a useful change in insertion loss for the device when the device is actuated. The device should have a first transmission state in which it provides a low attenuation of the applied RF electromagnetic wave signal and consequently exhibits a low device insertion loss and a second transmission state in which it provides a high attenuation of the applied RF signal and exhibits a high device insertion loss. The device must also be capable of being switched from one of the foregoing states to the other with only a minimum amount of switching energy. For example, when the device is used as the aforementioned protective switch for radar applications and the like, the device would be placed in the high loss state during the time that the radar transmitter is transmitting to protect the receiver of the radar set from the transmitted pulse and then actuated to the low loss state when the transmitter is not operating.

A suitable microstrip modulator/switch for use in the millimeter wave frequency region should also have a mechanically-rugged construction which is light in weight, compact in size and which is relatively inexpensive to manufacture and maintain. Because devices exhibiting the aforementioned useful change in insertion loss or attenuation characteristics are often called upon to act not only as switches but also as modulators, the term "microstrip switch" as used hereinafter in the specification and claims of this application shall be deemed to mean a device which is capable of functioning both as a modulator and a switch.

SUMMARY OF THE INVENTION

It is an object of this invention to provide a microstrip switch which is suitable for use in the millimeter wave region of the frequency spectrum.

It is a further object of this invention to provide a microstrip switch which is capable of being switched from one transmission state to the other transmission state with a minimum amount of switching energy.

It is a still further object of this invention to provide a microstrip switch of mechanically-rugged construction which is compact in size and low in weight and which can be manufactured and maintained relatively easily and inexpensively.

It is another object of this invention to provide a microstrip switch which is especially suitable for use in millimeter wave radar systems and the like.

Briefly, the microstrip switch of the invention comprises a length of microstrip transmission line dielectric substrate having top and bottom planar surfaces and an electrically conductive ground plane mounted on the bottom surface of the substrate. A ferrite rod having a rectangular cross-section and a dielectric constant greater than the dielectric constant of the substrate is mounted on the top surface of the substrate with one of the four sides of the rod abutting the substrate top surface and with the ends of the rod spaced a distance from the ends of the length of substrate. A pair of ramp-shaped dielectric waveguide members is mounted on the top surface of the substrate at the ends of the rod. Each of the ramp-shaped members has a dielectric constant which is substantially the same as the dielectric constant of the rod, a width which is substantially the same as the width of the rod, a planar bottom surface abutting the top surface of the substrate, an end surface abutting the end of the rod adjacent thereto and a downwardly-sloping planar top surface extending between the end of the rod adjacent thereto and the top surface of the substrate. A first length of electrically conductive microstrip conductor is mounted on the top surface of one of the ramp-shaped members and the top surface of the substrate in alignment with the longitudinal axis of the rod and extending between the end of the rod adjacent the one ramp-shaped member and the end of the length of substrate adjacent the one ramp-shaped member. A second length of electrically conductive microstrip conductor is mounted on the top surface of the other of the ramp-shaped members in alignment with the longitudinal axis of the rod and extending between the end of the rod adjacent the other ramp-shaped member and the end of the length of substrate adjacent the other ramp-shaped member. Finally, selectively operable means are provided for applying a unidirectional magnetic field along the longitudinal axis of the rod to cause Faraday rotation of electromagnetic wave energy traveling through the rod, whereby the ends of the first and second lengths of microstrip conductor adjacent the ends of the length of substrate act as the terminals of the microstrip switch and the ferrite rod controls the passage of electromagnetic wave energy between the terminals of the switch.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
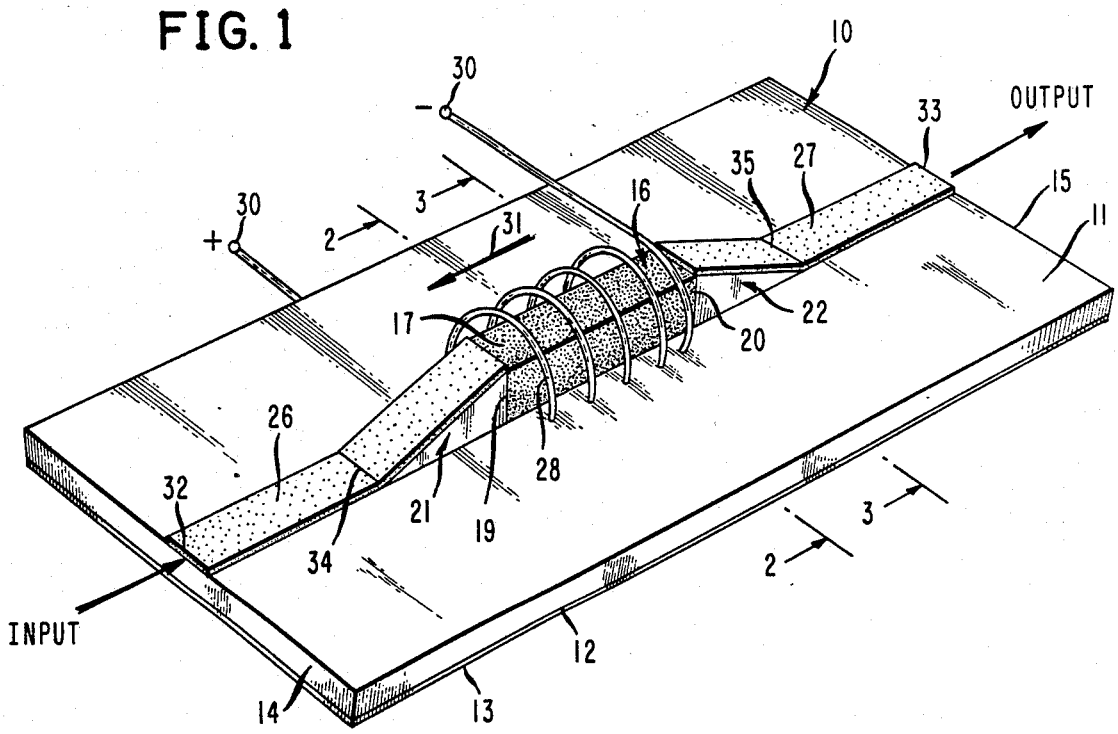
FIG. 1 is a perspective view of the microstrip switch of the invention.
Figure 2:
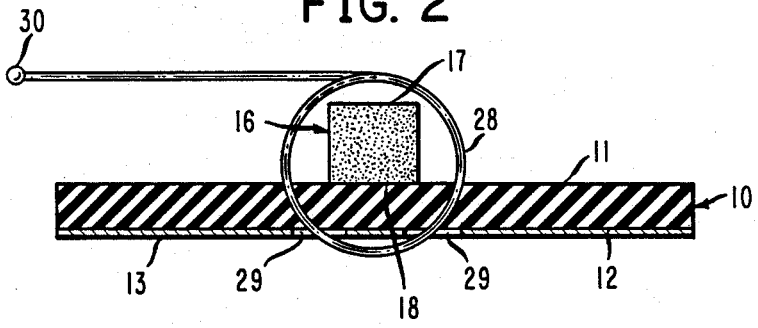
FIG. 2 is a full sectional view of the microstrip switch taken along the line 2—2 of FIG. 1.
Figure 3:
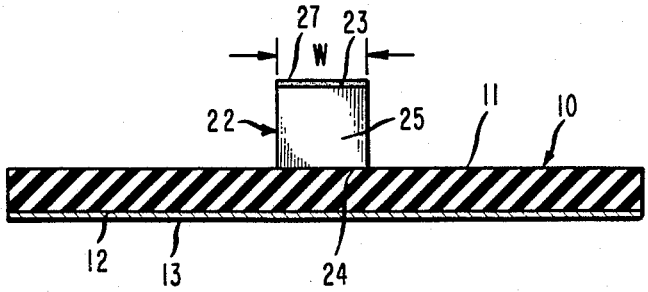
FIG. 3 is a full sectional view of the microstrip switch taken along the line 3—3 of FIG. 1.

Referring now to FIGS. 1-3 of the drawings, there is shown a microstrip switch constructed in accordance with the teachings of the present invention comprising a length of microstrip transmission line dielectric substrate, indicated generally as 10, having a planar top surface 11, a planar bottom surface 12 upon which is mounted an electrically conductive ground plane 13 and ends 14 and 15. The substrate 10 may, for example, comprise a section of conventional microstrip transmission line substrate which is approximately 0.010 inch thick and which is fabricated of Duroid or other similar dielectric material having a relatively low dielectric constant. The electrically conductive ground plane 13 covers the entire bottom surface 12 of the substrate and should be fabricated of a good electrically conductive metal, such as copper or silver, for example.

A ferrite rod, indicated generally as 16, having a rectangular cross-section, a top side or surface 17, a bottom side or surface 18 and ends 19 and 20 is mounted on the top surface 11 of the substrate with the bottom side 18 of the rod abutting the substrate top surface and with the ends 19 and 20 of the rod spaced a distance from the corresponding ends 14 and 15, respectively, of the substrate length 10.

The rod 16 is fabricated of a ferrite material, such as nickel zinc ferrite or lithium zinc ferrite, for example, which exhibits gyromagnetic behavior in the presence of a unidirectional magnetic field. The dielectric constant of the ferrite rod 16 is greater than the dielectric constant of the substrate 10. For example, if the substrate is fabricated of Duroid, it would have a dielectric constant of 2.2 and if the ferrite rod is fabricated of nickel zinc ferrire, the rod would have a dielectric constant of 13.

Figure 4:
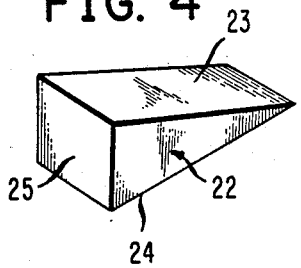
FIG. 4 is a perspective view of one of the ramp-shaped dielectric waveguide members shown in FIG. 1.

As seen in FIG. 1 of the drawings, a pair of ramp-shaped dielectric waveguide members, indicated generally as 21 and 22, is mounted on the top surface 11 of the substrate 10 at the ends 19 and 20 of the ferrite rod 16. Each of the ramp-shaped members 21 and 22 has a dielectric constant which is substantially the same as the dielectric constant of the rod, a width which is substantially the same as the width of the rod 16, a planar bottom surface abutting the top surface 11 of the substrate, an end surface abutting the end of the rod adjacent thereto and a downwardly-sloping planar top surface extending between the end of the rod adjacent thereto and the top surface of the substrate. For example, the ramp-shaped dielectric waveguide member 22 which is shown in FIGS. 1, 3 and 4 of the drawings is seen to have a width W which is substantially the same as the width of the rod 16, a downwardly-sloping planar top surface 23 which extends between the end 20 of the rod 16 adjacent thereto and the top surface 11 of the substrate, a planar bottom surface 24 which abuts the top surface 11 of the substrate and an end surface 25 which abuts the end 20 of the rod which is adjacent thereto. The ramp-shaped member 21 is of identical construction to the ramp-shaped member 22 except that its end surface abuts end 19 of the ferrite rod 16. Both of the ramp-shaped members 21 and 22 should be fabricated of a material having a dielectric constant which is substantially the same as the dielectric constant of the ferrire rod 16. For example, if the ferrite rod is fabricated of nickel zinc ferrite, the ramp-shaped members 21 and 22 may be conveniently fabricated of magnesium titanate which also has a dielectric constant of 13. In order to minimize the insertion loss of the microstrip switch when the switch is in the low loss transmission state, the ends 19 and 20 of the ferrite rod 16 may be joined to the corresponding end surfaces of the ramp-shaped members 21 and 22 by means of a low loss epoxy or adhesive, such as Scotch-Weld Structural Adhesive, for example, which is marketed by the 3M Company of St. Paul, Minn.

As seen in FIG. 1, a first length of electrically conductive microstrip conductor 26 is mounted on the downwardly-sloping top surface of the ramp-shaped member 21 and the top surface 11 of the substrate 10. The microstrip conductor length 26 is aligned with the longitudinal axis of the rod 16 and extends between the end 19 of the rod which is adjacent the member 21 and the end 14 of the length of substrate which is also adjacent the member 21. The longitudinal axis of the rod although not illustrated would correspond to the line formed by the directional arrows labeled "Input" and "Output" in FIG. 1. In a similar fashion, a second length of electrically conductive microstrip conductor 27 is mounted on the top surface 23 of the other ramp-shaped member 22 in alignment with the longitudinal axis of the rod and extends between the end 20 of the rod adjacent the member 22 and the end 15 of the substrate length 10 which is adjacent the member 22. The microstrip conductor lengths 26 and 27 should be fabricated of a good electrical conductor, such as copper or silver, for example.

The microstrip switch of the invention also has selectively operable means for applying a unidirectional magnetic field along the longitudinal axis of the rod 16 to cause Faraday rotation of electromagnetic wave energy traveling through the rod. As shown in FIGS. 1 and 2 of the drawings, the aforementioned means may take the form of a helical coil 28 which encircles the rod 16 and extends along the length of the rod. As seen in FIG. 2, the turns of the coil 28 are embedded in and pass through the substrate 10 and also pass through small apertures 29 in the ground plane 13. The turns of the coil 28 should be spaced a distance from the ferrite rod 16, as illustrated, for proper operation of the microstrip switch. The wire from which the coil is fabricated should be insulated to prevent sections of the coil from being shorted out by the ground plane 13. When the terminals 30 of the coil are connected to a source of d.c. voltage, a unidirectional magnetic field represented by the arrow 31 in FIG. 1 will be formed which extends the length of the ferrite rod 16 along the longitudinal axis of the rod. The magnitude and direction of the magnetic field 31 may be controlled by the amplitude and polarity, respectively, of the d.c. voltage applied to the coil terminals. For the voltage polarity illustrated in FIG. 1, the magnetic field would have the direction shown by the arrow 31.

The terminals of the microstrip switch are formed by the ends 32 and 33 of the first and second lengths 26 and 27, respectively, of microstrip conductor as shown in FIG. 1. In operation, when a millimeter wavelength signal is applied to the Input terminal 32 of the switch, it is transmitted along that portion of microstrip conductor length 26 which is mounted on the top surface 11 of the substrate 10 because that portion of the microstrip conductor 26 in conjunction with the ground plane 13 and the dielectric substrate 10 form a short section of a conventional microstrip transmission line. When the applied signal reaches the bottom (shown by the line 34) of the ramp-shaped dielectric waveguide member 21 it then passes along a microstrip transmission line which is formed by the portion of microstrip conductor length 26 which is on the upwardly-sloping top surface of the ramp-shaped member 21 and the ground plane 13 and the dielectric substrate 10. However, as the signal is progressing up the incline it begins to become transmitted by the solid dielectric waveguide material of the ramp-shaped member 21 because the dielectric constant of the ramp-shaped member 21 is substantially greater that the dielectric constant of the substrate 10.

When the applied signal reaches the top of the upwardly-sloping top surface of the ramp-shaped member 21 it becomes completely captured by the ferrite rod 16 which acts as a solid dielectric waveguide having the same or substantially the same dielectric constant as the ramp-shaped member 21. If the coil 28 is not energized, the applied RF signal is transmitted by the ferrite rod in the dielectric waveguide mode of transmission with very little loss to the ramp-shaped dielectric waveguide member 22 which has a portion of the microstrip conductor length 27 mounted on its downwardly-sloping top surface 23. Here, the reverse process takes place and the signal becomes gradually recaptured by the microstrip transmission line mode of transmission. By the time the applied signal reaches the Output terminal 33 of the switch, it will have been completely recaptured by the microstrip transmission line mode of operation.

If the coil 28 is energized by a suitably applied d.c. voltage, the unidirectional magnetic field 31 which is produced along the longitudinal axis of the ferrite rod 16 will cause the ferrite rod to rotate the applied signal passing through the rod approximately 90 degrees because of the well-known Faraday rotation effect which is produced by the interaction of the magnetic field and the gyromagnetic properties of the ferrite. Since the applied RF signal is now rotated approximately 90 degrees, the applied signal will no longer be properly oriented for transmission along a microstrip transmission line and a scattering of the signal will be produced. The scattering of the signal resulting from the misalignment of the signal with the microstrip transmission line results in a high applied signal loss. Accordingly, very little of the applied RF signal will reach the Output terminal 33 of the switch. By selectively energizing the terminals 30 of the coil 28, the microstrip switch may be placed in either its high loss transmission or off state or its low loss transmission or on state. It will be noted that the microstrip switch of the invention is bidirectional in operation so that the applied RF electromagnetic wave energy signal may be applied to either terminal 33 or terminal 32. Additionally, it should be noted that the direction of the magnetic field 31 will not affect the operation of the switch so that a reversal of polarity of the d.c. control signal applied to the control terminals 30 of the switch will not affect the bidirectional operation of the switch. Although the aforementioned description of switch operation and construction has been given with reference to an applied signal in the millimeter wave region of the frequency spectrum, it is apparent that the use of the switch is not limited to signals in this region of the frequency spectrum. Preliminary testing of a microstrip switch constructed in accordance with the invention using a ferrite rod approximately 0.6 inch long and operating in the 35 GHz region of the frequency spectrum indicates that the switch should provide greater than 15 dB loss for the high attenuation or off state and a 1 dB insertion loss for the low attenuation or on state.

It is believed apparent that many changes could be made in the construction and described uses of the foregoing microstrip switch and many seemingly different embodiments of the invention could be constructed without departing from the scope thereof. For example, each of the lengths 26 and 27 of microstrip conductor could be fabricated in two separate sections which are electrically interconnected by means such as soldering. The two sections of conductor length 26 could be electrically interconnected along the line 34 at the bottom of the sloping top surface of ramp-shaped member 21 and the two sections of conductor 27 could be interconnected at the line 35 at the bottom of the ramp-shaped member 22 as shown in FIG. 1. Accordingly, it is intended that all matter contained in the above description or shown in the accompanying drawings shall be interpreted as illustrative and not in a limiting sense.

What is claimed is:

1. A microstrip switch comprising a length of microstrip transmission line dielectric substrate having top and bottom planar surfaces;

an electrically conductive ground plane mounted on the bottom surface of said substrate;

a ferrite rod having a rectangular cross-section and a dielectric constant greater than the dielectric constant of said substrate, said rod being mounted on the top surface of said substrate with one of the four sides of the rod abutting said substrate top surface and with the ends of said rod spaced a distance from the ends of said length of substrate;

a pair of ramp-shaped dielectric waveguide members mounted on the top surface of said substrate at the ends of said rod, each of said ramp-shaped members having a dielectric constant which is substantially the same as the dielectric constant of said rod, a width which is substantially the same as the width of said rod, a planar bottom surface abutting the top surface of said substrate, an end surface abutting the end of said rod adjacent thereto and a downwardly-sloping planar top surface extending between the end of said rod adjacent thereto and the top surface of said substrate;

a first length of electrically conductive microstrip conductor mounted on the top surface of one of said ramp-shaped members and the top surface of said substrate in alignment with the longitudinal axis of said rod and extending between the end of said rod adjacent said one ramp-shaped member and the end of said length of substrate adjacent said one ramp-shaped member;

a second length of electrically conductive microstrip conductor mounted on the top surface of the other of said ramp-shaped members in alignment with the longitudinal axis of said rod and extending between the end of said rod adjacent said other ramp-shaped member and the end of said length of substrate adjacent said other ramp-shaped member; and selectively operable means for applying a unidirectional magnetic field along the longitudinal axis of said rod to cause Faraday rotation of electromagnetic wave energy traveling through said rod, whereby the ends of said first and second lengths of microstrip conductor adjacent the ends of said length of substrate act as the terminals of said switch and said ferrite rod controls the passage of electromagnetic wave energy between said terminals.

2. A microstrip switch as claimed in claim 1 wherein said selectively operable means for applying a unidirectional magnetic field along the longitudinal axis of said rod comprises a helical coil encircling said rod and extending along the length of the rod, the turns of said coil passing through said substrate and said ground plane and being spaced a distance from said rod.

3. A microstrip switch as claimed in claim 2 wherein each of said pair of ramp-shaped dielectric waveguide members is fabricated of magnesium titanate.

4. A microstrip switch as claimed in claim 3 wherein said ferrite rod is fabricated of nickel zinc ferrite.

5. A microstrip switch as claimed in claim 3 wherein said ferrite rod is fabricated of lithium zinc ferrite.

* * * * *